US011976668B2

(12) United States Patent
Strehle et al.

(10) Patent No.: US 11,976,668 B2
(45) Date of Patent: May 7, 2024

(54) FLOW GUIDING DEVICE AND FAN ASSEMBLY WITH FLOW GUIDING DEVICE

(71) Applicant: ebm-papst Mulfingen GmbH & Co. KG, Mulfingen (DE)

(72) Inventors: Michael Strehle, Ingelfingen (DE); Björn Sudler, Boxberg (DE); Daniel Conrad, Langenbrettach (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 144 days.

(21) Appl. No.: 16/742,957

(22) Filed: Jan. 15, 2020

(65) Prior Publication Data

US 2020/0224667 A1 Jul. 16, 2020

(30) Foreign Application Priority Data

Jan. 16, 2019 (DE) ..... 10 2019 101 096.9

(51) Int. Cl.
*F04D 29/42* (2006.01)
*F04D 19/00* (2006.01)
*F04D 29/54* (2006.01)

(52) U.S. Cl.
CPC ..... *F04D 29/4253* (2013.01); *F04D 19/002* (2013.01); *F04D 29/547* (2013.01)

(58) Field of Classification Search
CPC .. F04D 29/4253; F04D 29/547; F04D 59/545; F04D 19/002; F04D 17/00; F04D 19/00; F04D 29/541–29/545; F04D 29/542; F04D 29/522; F04D 29/526; F04D 29/42; F04D 29/4206; F04D 29/4226; F04D 29/444; F04D 29/663; F04D 29/664; F04D 29/52–29/5893; F04D 29/4213
See application file for complete search history.

(56) References Cited

U.S. PATENT DOCUMENTS 3,976,393 A * 8/1976 Larson ..... F04D 29/646 415/220
5,445,215 A * 8/1995 Herbert ..... F04D 27/009 165/80.3

(Continued)

FOREIGN PATENT DOCUMENTS

DE 10 2017 110 642 A1 11/2018
FR 2922610 A1 4/2009

OTHER PUBLICATIONS

European Office Action dated Jan. 22, 2024 in corresponding European Application No. 19 216 382.2 (5 pages).

*Primary Examiner* — Bryan M Lettman
(74) *Attorney, Agent, or Firm* — Harness, Dickey & Pierce, P.L.C.

(57) ABSTRACT

A flow guiding device for use on a fan assembly with a motor-operated radial impeller rotating about an axis of rotation. The guiding device has an outer housing and an inner diffuser. A flow duct is formed between the outer housing and inner diffuser. The flow duct extends along an axial flow direction. The outer housing forms a receiving space for the integral holding of the radial impeller. The impeller borders, in the axial direction, on the inner diffuser. The impeller, during operation, takes in a flow axially and blows it out radially into the flow duct. The flow duct is adapted to deflect the flow from a radial direction into an axial direction.

14 Claims, 4 Drawing Sheets

(56) References Cited

U.S. PATENT DOCUMENTS

| | | | | |
|---|---|---|---|---|
| 5,586,861 | A * | 12/1996 | Berger | F04D 27/00 415/118 |
| 2013/0309065 | A1* | 11/2013 | Johnson | F04D 29/281 415/119 |
| 2018/0080476 | A1* | 3/2018 | McCune | F02C 7/06 |
| 2018/0202464 | A1* | 7/2018 | Soutar | F04D 29/4226 |
| 2018/0209442 | A1* | 7/2018 | Sawada | F04D 29/44 |
| 2018/0226858 | A1* | 8/2018 | Mas | H02K 7/14 |
| 2018/0245601 | A1* | 8/2018 | Hayamitsu | A47L 5/22 |
| 2018/0283401 | A1* | 10/2018 | Hustvedt | F04D 29/661 |
| 2019/0353364 | A1* | 11/2019 | Loercher | F04D 29/626 |

* cited by examiner

FLOW GUIDING DEVICE AND FAN ASSEMBLY WITH FLOW GUIDING DEVICE

CROSS-REFERENCE TO RELATED APPLICATION

This application claims priority to German Application No. 10 2019 101 096.9, filed Jan. 16, 2019. The disclosure of the above application is incorporated herein by reference.

FIELD

The disclosure relates to a flow guiding device for use on a fan assembly, with a motor-operated radial impeller, as well as, the fan assembly with a corresponding flow guiding device.

BACKGROUND

The influencing of the flow created by a radial fan after the flow emerges from the radial impeller by a flow guiding device, according to the disclosure, makes it possible to boost the static efficiency. This is especially advantageous when the radial flow needs to be deflected into an axial flow and into a subsequent component, such as a heat exchanger, that needs to receive a homogeneous axial outflow field.

A split nozzle at the intake side has already proven to work well for this. One such device has been described in the German patent application DE 10 2017 110 642 A1. The disclosure of this patent application is hereby incorporated by reference into the present application. The present flow guiding device provides for the flow guiding geometry described therein.

The problem that the disclosure proposes to solve is to present a flow guiding device to increase the static efficiency of fan assemblies having a radial impeller where the radially blown flow is then axially deflected.

SUMMARY

This problem is solved by the combination of features according to a flow guiding device for use on a fan assembly with a motor-operated radial impeller rotating about an axis of rotation. The flow guiding device comprises an outer housing and an inner diffuser. A flow duct is formed between the outer housing and inner diffuser. The flow duct extends along an axial flow direction. The outer housing forms a receiving space for holding the radial impeller. The receiving space borders, in the axial direction, on the inner diffuser during operation. The radial impeller takes in a flow axially and blows it out radially into the flow duct. The flow duct is adapted to deflect the flow from a radial direction into an axial direction.

According to the disclosure, a flow guiding device is use on a fan assembly with a motor-operated radial impeller rotating about an axis of rotation. It comprises an outer housing and an inner diffuser. Between the two, there is formed a flow duct extending along an axial flow direction. The outer housing forms a receiving space for the integral holding of the radial impeller. The impeller borders, in the axial direction, on the inner diffuser. The impeller, during operation takes in a flow axially and blows it out radially into the flow duct. The flow duct is adapted to deflect the flow from a radial to an axial direction. The axial flow direction runs parallel to the axis of rotation of the radial impeller. The inner diffuser and the outer housing are preferably cylindrical or substantially cylindrical and arranged coaxial to each other.

Due to the flow duct formed downstream in the flow direction by the outer housing and the inner diffuser, the dynamic pressure energy in the flow is transformed into static pressure energy, thereby solving the problem.

In one embodiment of the flow guiding device, the flow duct extends up to its outlet. Thus, the flow is guided along the entire length of the flow guiding device.

Moreover, the transformation of the dynamic pressure energy into static pressure energy in the flow guiding device is favored. Thus, a flow cross section area of the flow duct becomes larger toward the outlet in the manner of a diffuser. This is created, for example, in that the inner diffuser is retracted toward the outlet. Its lateral surface extends toward the axis of rotation of the radial impeller along the axial course up to the outlet.

Moreover, the flow guiding device in one embodiment, has the receiving space for the radial impeller bordering on an inlet of the flow guiding device.

For noise reduction, in one embodiment of the flow guiding device, the inner diffuser has a perforated lateral surface. Likewise for this purpose, in one embodiment of the flow guiding device, the outer housing has a perforated inner wall surface. The flow can flow entirely or partially through the perforation of the lateral surface of the inner diffuser or through the inner wall surface of the outer housing and reduce the acoustic noise emission. Furthermore, insulating materials may be optionally incorporated, for example, inside the inner diffuser or in portions of the perforation.

One modification of the flow guiding device to further increase the static efficiency proposes that flow guide blades are arranged in the flow duct and are spaced apart in the circumferential direction. In one advantageous embodiment, the flow guide blades extend from the region of the receiving space for the radial impeller up to the outlet. This provides a guiding for the flow from the outlet of the radial impeller to the outlet of the flow guiding device. The increasing of the static efficiency is favored by a reduced swirl of the flow by the flow guide blades.

The inner diffuser comprises a diffuser space bounded off toward the flow duct by its lateral surface, formed about the axis of rotation of the radial impeller. In one modification, guide blades are likewise provided in this diffuser space and extend in the direction of the outlet. It makes sense to provide such guide blades if the lateral surface of the inner diffuser is not closed, but rather perforated. Thus, the flow can run also in part through the diffuser space as well as the flow duct. The guide blades may serve at the same time as stiffening ribs for the inner diffuser. Thus, they may also be provided when there is no flow into the diffuser space.

Moreover, in one embodiment of the flow guiding device, it is advantageous where the flow guide blades are formed integrally as a single piece with the inner diffuser.

In another embodiment with a compact structure, a motor receptacle is integrated in the inner diffuser.

Furthermore, in one modification of the flow guiding device, the outer housing comprises an integral Venturi nozzle at the inlet. The radial impeller may thus interact with the Venturi nozzle on the outer housing and extend for example by its cover disk in the axial direction into the Venturi nozzle, in order to provide an axial overlapping.

For the variable adaptability of the flow guiding device, an embodiment is advantageous where the inner diffuser is designed as a removable insert in the outer housing. Thus, the flow duct or the receiving space for the radial impeller can be adapted at will by replacing the inner diffuser.

Also included is a fan assembly having a radial impeller and an electric motor connected to it. The radial impeller is arranged in the receiving space of the flow guiding device and its flow taken in axially is deflected by the flow duct into an axial flow.

DRAWINGS

Other advantageous modifications of the disclosure are characterized in the dependent claims or shall be presented more closely below, together with the description of the preferred embodiment of the disclosure with the aid of the figures. There are shown:

DETAILED DESCRIPTION

Figure 1:
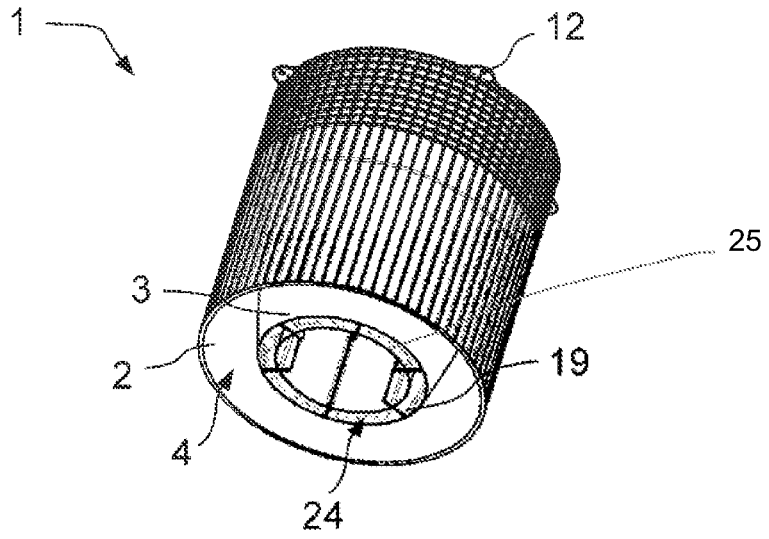
FIG. 1 is a perspective view of a flow guiding device in a first embodiment.

FIGS. 1-4 show a first embodiment of the flow guiding device 1. The flow guiding device 1 includes a cylindrical outer housing 2 and a substantially cylindrical inner diffuser 3 situated coaxially to the outer housing 2. The inner diffuser 3 extends for around half the axial length of the outer housing 2 in the axial direction along the axis of rotation RA. The outer housing 2 forms an inlet 8 to draw in a flow across a radial impeller (shown in phantom). At the inlet 8, a Venturi nozzle 11 is formed.

Adjoining this in the flow direction and axially bordering on the inner diffuser 3, the outer housing 2 includes the receiving space 5. The receiving space 5 is for the integral holding of the radial impeller such that it draws in the flow axially across the Venturi nozzle 11, at the inlet 8, and blows it out radially in the direction of the flow duct 4.

The flow duct 4 is formed by the inner wall of the outer housing 2 and by the lateral surface of the inner diffuser 3. The flow duct 4 deflects the flow coming from the radial impeller radially in the axial direction. The inner diffuser 3 is conically retracted toward the axis of rotation RA toward the outlet 9. Thus, the flow cross section area in the flow duct 4 is increased, looking in the flow direction.

Alternatively or additionally, the outer housing 2 may also widen in order to increase the flow cross section area. In another alternative embodiment, the inner diffuser 3 is not conically retracted toward the axis of rotation RA, but instead runs in cylindrical manner, i.e., parallel to the axis of rotation. The inner diffuser 3 and the outer housing 2 terminate in the same axial plane at the outlet 9.

Figure 2:
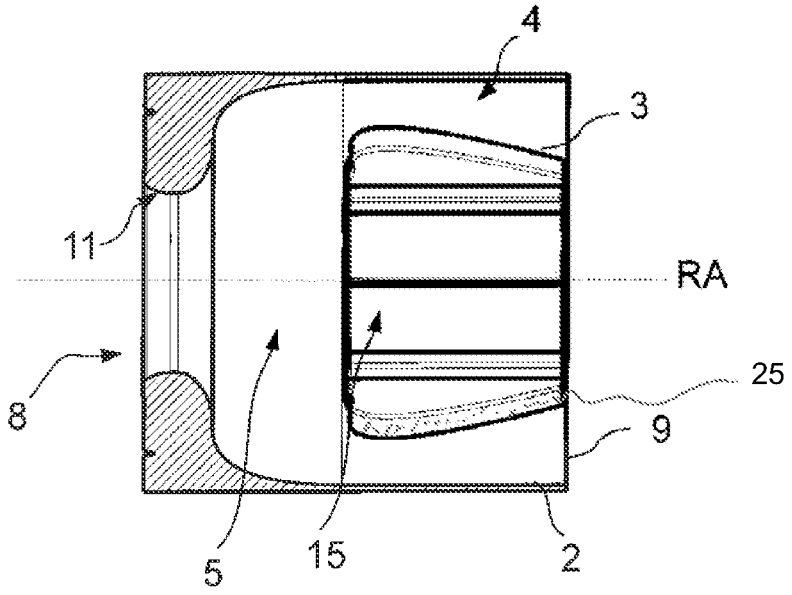
FIG. 2 is a lateral sectional view of the flow guiding device of FIG. 1.

Referring to FIG. 2, a motor receptacle 15 is shown for the secure holding of an electric motor (shown in phantom) to drive the radial impeller about the axis of rotation. The electric motor is integrated in the inner diffuser 3, adjoining the receiving space 5. The inner diffuser has multiple walls and provides a chamber 24 between the walls to contain insulating material 25. The chamber is subdivided by webs 19 distributed in the circumferential direction.

Figure 3:
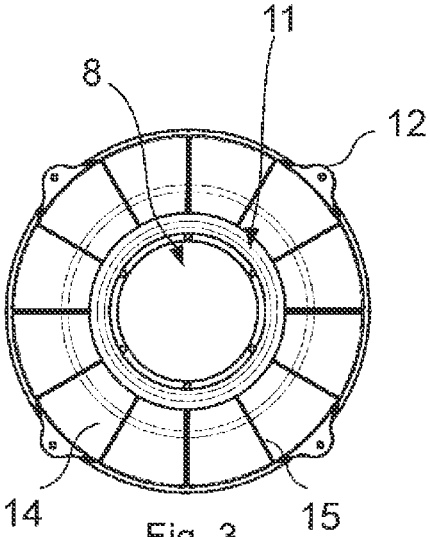
FIG. 3 is an axial top plan view of the inlet side of the flow guiding device of FIG. 1.
Figure 4:
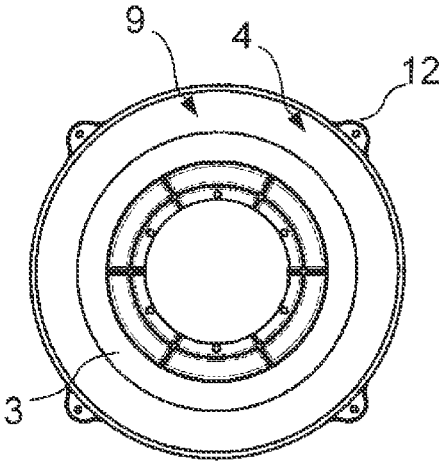
FIG. 4 is an axial top plan view of the outlet side of the flow guiding device of FIG. 1.
Figure 5:
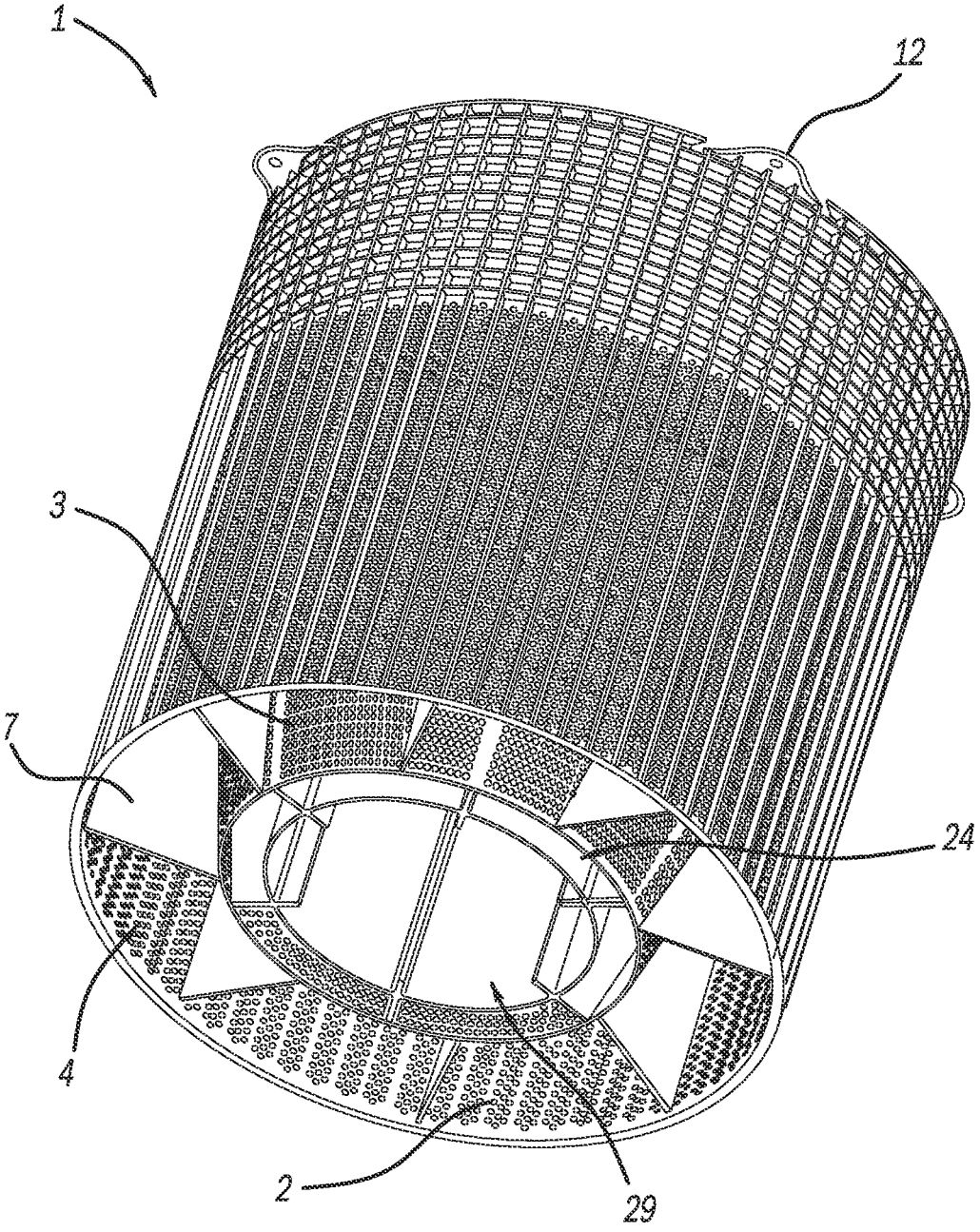
FIG. 5 is a perspective view of a flow guiding device in a second embodiment.

In the respective axial top plan views of FIGS. 3 and 4, one can furthermore see the connection plate 14 at the inlet 8. The outlet 9 includes stiffening webs 17 distributed in the circumferential direction. Also, the mounting brackets 12 are distributed in the circumferential direction.

FIGS. 5-8 show another exemplary embodiment, with the same features as in the embodiment of FIGS. 1-4 and further features. As a modification of the first exemplary embodiment, the outer housing 2 has a perforated inner wall surface with a plurality of openings 32. The lateral surface of the inner diffuser 3 is also perforated with openings 31. Thus, a flow connection to the chamber 24 is formed. In the embodiment shown, the inner wall of the inner diffuser 3 is closed. Alternatively, however, this may likewise be provided with openings. Thus, a flow connection to the diffuser space 29 is produced. For this purpose, guide blades 7 are already provided in the diffuser space 29, extending in the direction of the outlet 9. The guide blades 7 serve at the same time as stiffening ribs for the inner diffuser.

Figure 6:
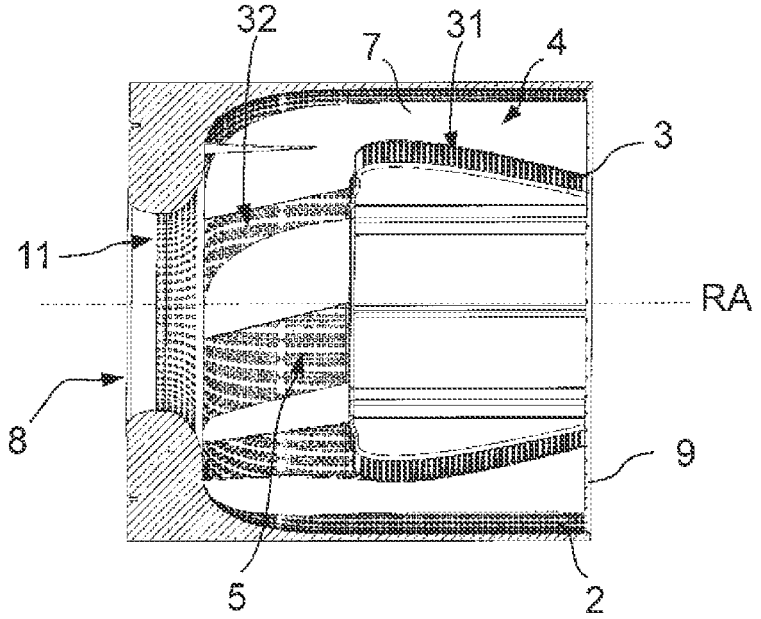
FIG. 6 is a lateral sectional view of the flow guiding device of FIG. 5.
Figure 7:
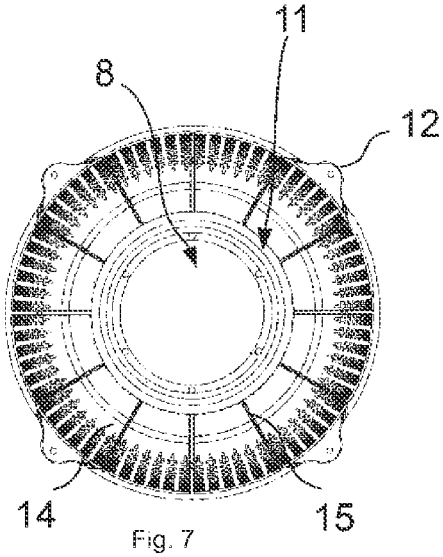
FIG. 7 is an axial top plan view of the inlet side of the flow guiding device of FIG. 5.
Figure 8:
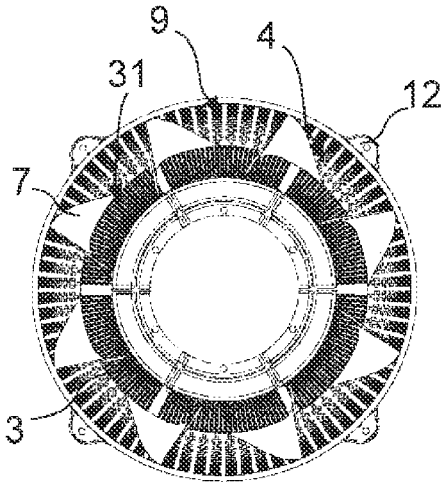
FIG. 8 is an axial top plan view of the outlet side of the flow guiding device of FIG. 5.

In the flow guiding device 1, flow guide blades 7 are arranged in the flow duct 4 in the circumferential direction. They are spaced apart and extend from the region of the receiving space 5 for the radial impeller to the outlet 9, as can be seen in FIG. 6. The flow guide blades 7 run, looking in the radial direction, from the lateral surface of the inner diffuser 3 to the inner wall surface of the outer housing 2.

As further alternative modifications, any desired combination of the exemplary embodiments shown can be used. For example, a perforated lateral surface of the inner diffuser 3 and a perforated inner wall surface of the outer housing 2, without the use of flow guide blades 7. Also as a variant, for example, only the inner wall surface of the outer housing 2 or only the lateral surface of the inner diffuser 3 may be perforated. Furthermore, the flow guide blades 7 may be integrated in the embodiment of FIGS. 1-4, without this being explicitly shown separately.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A flow guiding device for use on a fan assembly with a motor operated radial impeller rotating about an axis of rotation, comprising:

an outer housing and an inner diffuser, a flow duct formed between the outer housing and inner diffuser, the flow device extending along an axial flow direction;

the outer housing forms a receiving space for holding the radial impeller, the receiving space bordering in the axial direction on the inner diffuser during operation, the radial impeller takes in a flow axially and blows it out radially into the flow duct, and the flow duct is adapted to deflect the flow from a radial direction into the axial flow direction; and multiple walls in the inner diffuser, an innermost wall concentrically positioned inside an outermost wall forming a closed chamber between the multiple walls for receiving an insulation material and prohibiting airflow through the chamber at least the outermost wall of the multiple walls is subjected to the flow in the flow duct and the multiple walls defining a motor receptacle, devoid of insulation, inward of the innermost wall of the multiple walls and at least one web circumferentially subdividing the chamber.

2. The flow guiding device according to claim 1, wherein the flow duct extends continuously from the receiving space to an outlet of the flow guiding device.

3. The flow guiding device according to claim 2, wherein a flow cross section area of the flow duct becomes larger toward the outlet in the manner of a diffuser.

4. The flow guiding device according to claim 2, wherein the inner diffuser comprises a diffuser space delimited toward the flow duct by its lateral surface, where guide blades extend along the lateral surface toward the outlet.

5. The flow guiding device according to claim 1, wherein the receiving space for the radial impeller borders on an inlet of the flow guiding device.

6. The flow guiding device according to claim 1, wherein the outer housing has a perforated inner wall surface.

7. The flow guiding device according to claim 1, wherein flow guide blades are arranged in the flow duct, the flow blades are spaced apart in the circumferential direction.

8. The flow guiding device according to claim 7, wherein the flow guide blades extend from a region of the receiving space for the radial impeller to the outlet.

9. The flow guiding device according to claim 7, wherein the flow guide blades are formed integrally as a single piece with the inner diffuser.

10. The flow guiding device according to claim 1, wherein the motor receptacle is integrated in the inner diffuser.

11. The flow guiding device according to claim 1, wherein the outer housing comprises an integral Venturi nozzle at the inlet.

12. The flow guiding device according to claim 1, wherein the inner diffuser is designed as a removable insert in the outer housing.

13. The flow guiding device according to claim 1, wherein the inner diffuser and the outer housing are designed substantially cylindrical.

14. A fan assembly having the radial impeller and the motor is an electric motor, the radial impeller is arranged in the receiving space of the flow guiding device according to claim 1.

* * * * *